US011219325B2

(12) United States Patent
Kuechle

(10) Patent No.: US 11,219,325 B2
(45) Date of Patent: Jan. 11, 2022

(54) CUSTOMIZABLE DRINK COASTER WITH MODULAR MAGNETIC CLOSURE FOR DISPLAY ITEM INTERCHANGEABILITY

(71) Applicant: Austin Kuechle, Calgary (CA)

(72) Inventor: Austin Kuechle, Calgary (CA)

( * ) Notice: Subject to any disclaimer, the term of this patent is extended or adjusted under 35 U.S.C. 154(b) by 0 days.

(21) Appl. No.: 16/798,406

(22) Filed: Feb. 23, 2020

(65) Prior Publication Data

US 2020/0275794 A1 Sep. 3, 2020

Related U.S. Application Data

(60) Provisional application No. 62/812,981, filed on Mar. 2, 2019.

(51) Int. Cl.
*A47G 23/00* (2006.01)
*A47G 23/03* (2006.01)

(52) U.S. Cl.
CPC ..... *A47G 23/0306* (2013.01); *A47G 23/0316* (2013.01)

(58) Field of Classification Search
CPC ..... A47G 7/02; A47G 23/03; A47G 23/0303
See application file for complete search history.

(56) References Cited

U.S. PATENT DOCUMENTS 3,017,051 A * 1/1962 Rosenfeld ..... A47G 23/0309 248/346.11
5,695,270 A * 12/1997 Collet ..... A47G 23/0309 215/393
5,938,162 A * 8/1999 Honjo ..... A47G 23/032 248/346.11
6,310,329 B1 * 10/2001 Carter ..... A47G 19/2288 219/430
7,331,194 B2 * 2/2008 Lefkowitz ..... A47G 23/0313 62/457.4
10,068,502 B1 * 9/2018 Sax ..... G09F 13/20
2009/0101659 A1 * 4/2009 Morlan ..... A47G 23/032 220/592.16

* cited by examiner

*Primary Examiner* — Steven M Marsh

(57) ABSTRACT

The present invention relates to a novel magnetic assembly often, but not exclusively, used as a drink coaster. More particularly, the invention relates to a modular, magnetically closing assembly wherein the operator can insert, interchange and display various items such as, but not limited to, photos, documents, art, and flowers.

5 Claims, 4 Drawing Sheets

CUSTOMIZABLE DRINK COASTER WITH MODULAR MAGNETIC CLOSURE FOR DISPLAY ITEM INTERCHANGEABILITY

CROSS-REFERENCE TO RELATED APPLICATIONS

Provisional Patent Application No. 62/812,981 filed on 2 Mar. 2019 12:51:46

Glossary

TABLE A is the "Glossary of Terms" as they relate to the present invention.

| Term | Defined within this document as |
|---|---|
| Device | The present invention. |
| Display | To show or exhibit; make visible. |
| Closed Position | The current invention's position when the bottom plate is attached. |
| Coaster or Drink Coaster | A tray especially for placing under a drinking glass to protect a table from moisture. |
| Interchangeable or Customizable | Capable of replacing or changing places with something else. |
| Magnetic Closure | The novel magnetic mechanism used to open and close the present invention. |
| Magnetic Pole | The region of the magnet toward which the lines of magnetic induction converge (south pole) or from which the lines of induction converge (north pole). |
| Modular | Composed of removable sections for easy constructability and flexible arrangement. |
| Open Position | The current invention's position when the bottom plate is detached. |
| Operator | The person using the current invention. |
| Display(ed) Item | Items such as, but not limited to, photos, documents, art, flowers, etc. |
| Recess | An area set back or indented. |
| Standard Coaster Size | Generally, but not limited to, a square measuring 4 inches wide by 4 inches long. |
| Static | A single piece with no moving or removable parts. |
| Trending | Currently popular and widely utilized on the internet. Especially referring to social media websites. |

BACKGROUND OF THE INVENTION

Home décor customization is a common area of interest for most people. Types of customization can range from varying colors to bold patterns. With ever changing design trends, a need exists for the repurposing and reusability of home décor.

Recently, the development of customized coasters utilizing social media content have become popular. The standard coaster size complements the trending square photo aspect ratio of the current social media platforms. However, these current coasters are made with permanent images and are not intended for further customization.

Certain coasters have been developed with a slot type insertion port for the interchangeability of displayed items. These coasters are configured statically with no moving parts.

However, these static coasters suffer many drawbacks that hinder the aesthetic appeal of the coaster. The slot type insertion port is typically wider than the displayed item is thick. This results in the warping of the displayed item when exposed to heat and moisture within the confined slot space. These problematic ambient conditions are common and frequent when hot beverages are involved. The fixtures used to install the insertion port also reduce the useable surface area for showing the displayed item.

Another drawback is that the current customizable coasters are primarily made of glass which is fragile and susceptible to fractures under cyclic impact. The primary function of a coaster is to withstand cyclical impact of varying sizes and materials hence a more robust material is preferred.

Therefore, a need exists in the field of novel, reusable, customizable drink coasters capable of i) optimally presenting a displayed item without distortion, ii) aesthetically adapting to the shifting home décor trends through the interchangeability of displayed items and iii) able to absorb the cyclic impact of various shapes, sizes and materials.

BRIEF SUMMARY OF THE INVENTION

The present invention relates to a novel magnetic assembly often, but not exclusively, used as a modular drink coaster which promotes the interchangeability of displayed items via a removable magnetic back plate.

The present disclosure comprises of a novel magnetic closure. The magnets apply constant pressure to the displayed item preventing it from warping when exposed to humidity.

The present disclosure is transparent and durable. In some instances, acrylic cast sheet is used as the primary material which can withstand continuous cyclic impact.

In some instances, the device is four sided, and the magnetic closure consists of four sets of magnets with each set comprising of two magnets. The sets of magnets are situated on each of the device's four corners. Four south magnetic pole magnets are situated on the top face and four north magnetic pole magnets are situated on the bottom plate. The magnet orientations are such that the exposed side of each set is facing each other. When closed the four north magnetic pole magnets connect with the four south magnetic pole magnets and the bottom plate sits flat against to the top face with the displayed item squeezed in between the aforementioned components.

In some instances, the bottom plate has one beveled semicircle cutout centered along one side for access to remove the back plate and access the displayed item.

BRIEF DESCRIPTION OF DRAWINGS

Some embodiments of the present invention are illustrated as an example and are not limited by the figures of the accompanied drawings.

DRAWING REFERENCES AND DEFINITIONS

TABLE B is the "Drawing Component References". It defines where each component can be found and what each component is known as within this specification.

Figure 1:
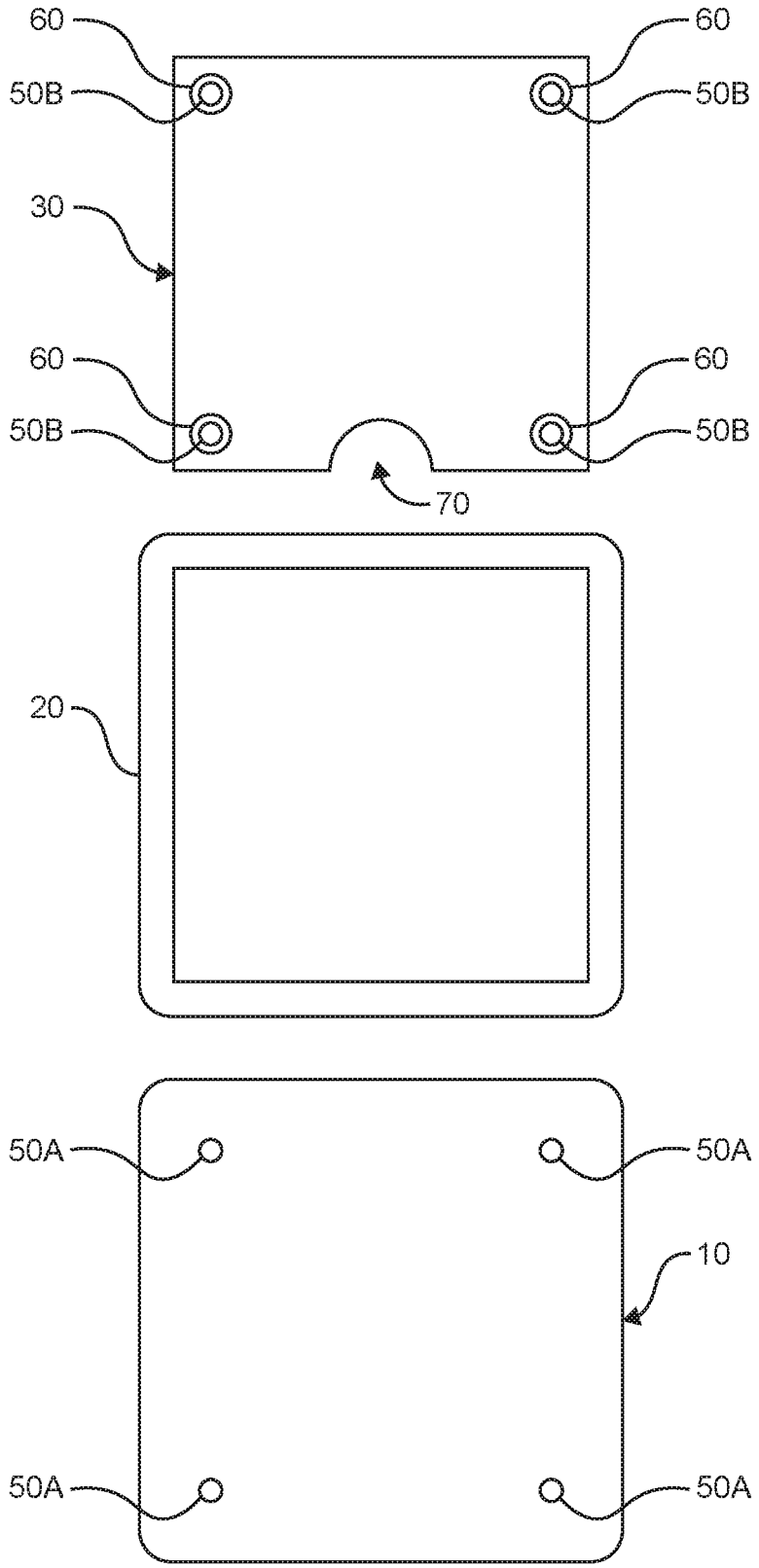
FIG. 1 is a top-down view of the device components before assembly.
Figure 2:
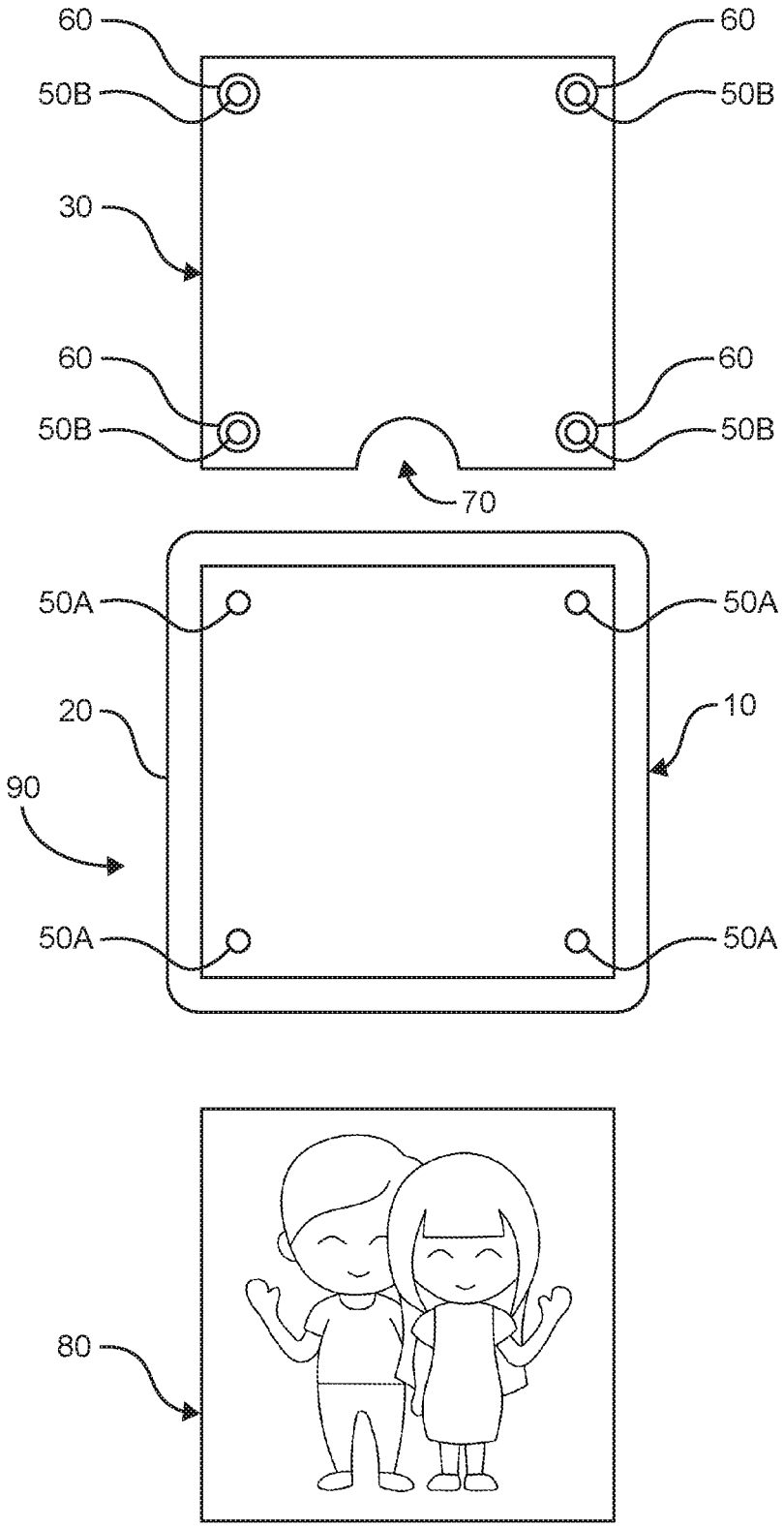
FIG. 2 is a top-down view of the individual device pieces in the 'open position'. The displayed item is also depicted before insertion into the device.
Figure 3:
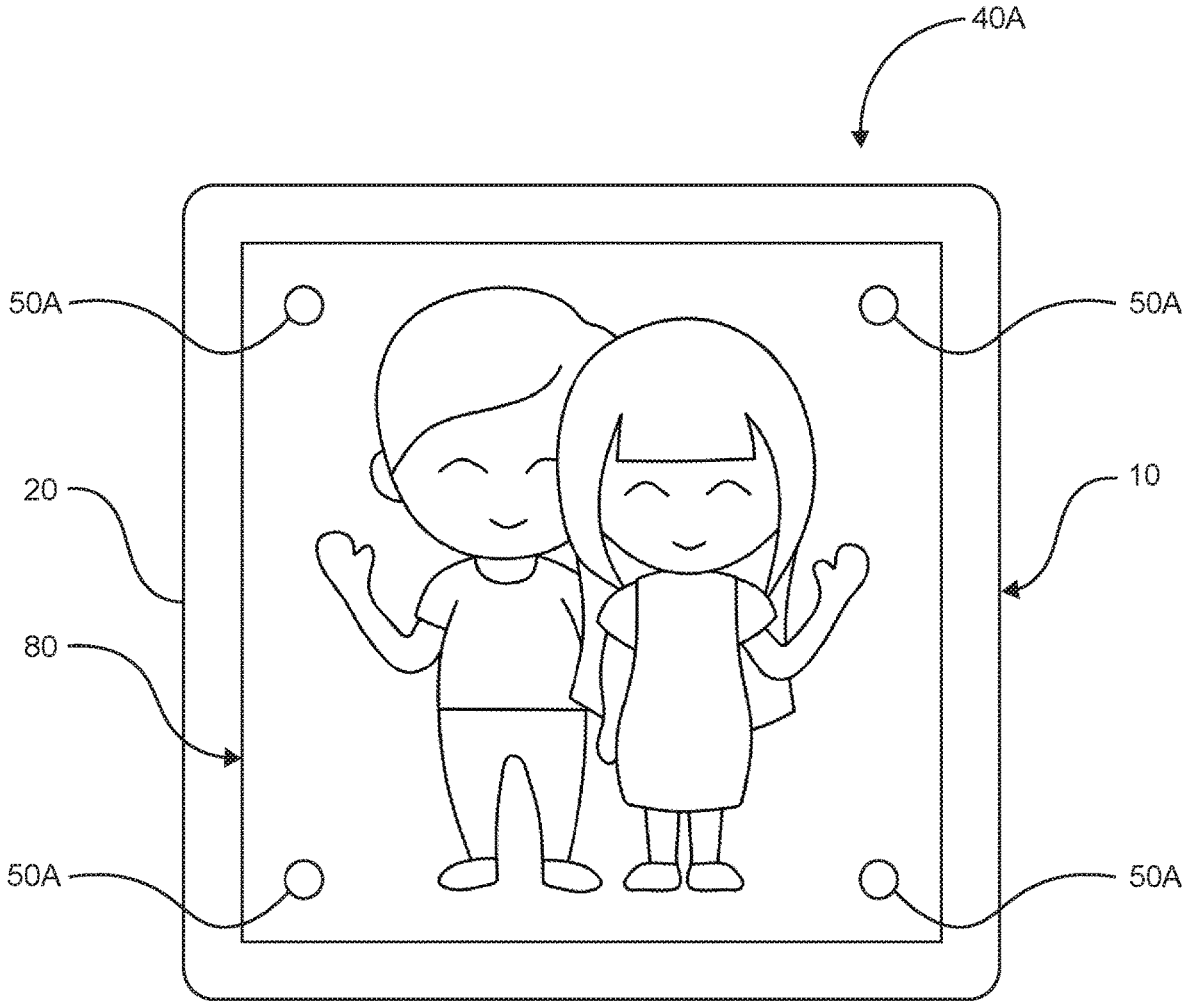
FIG. 3 is a top-down view of the font of the device in the 'closed position' with the displayed item inserted.
Figure 4:
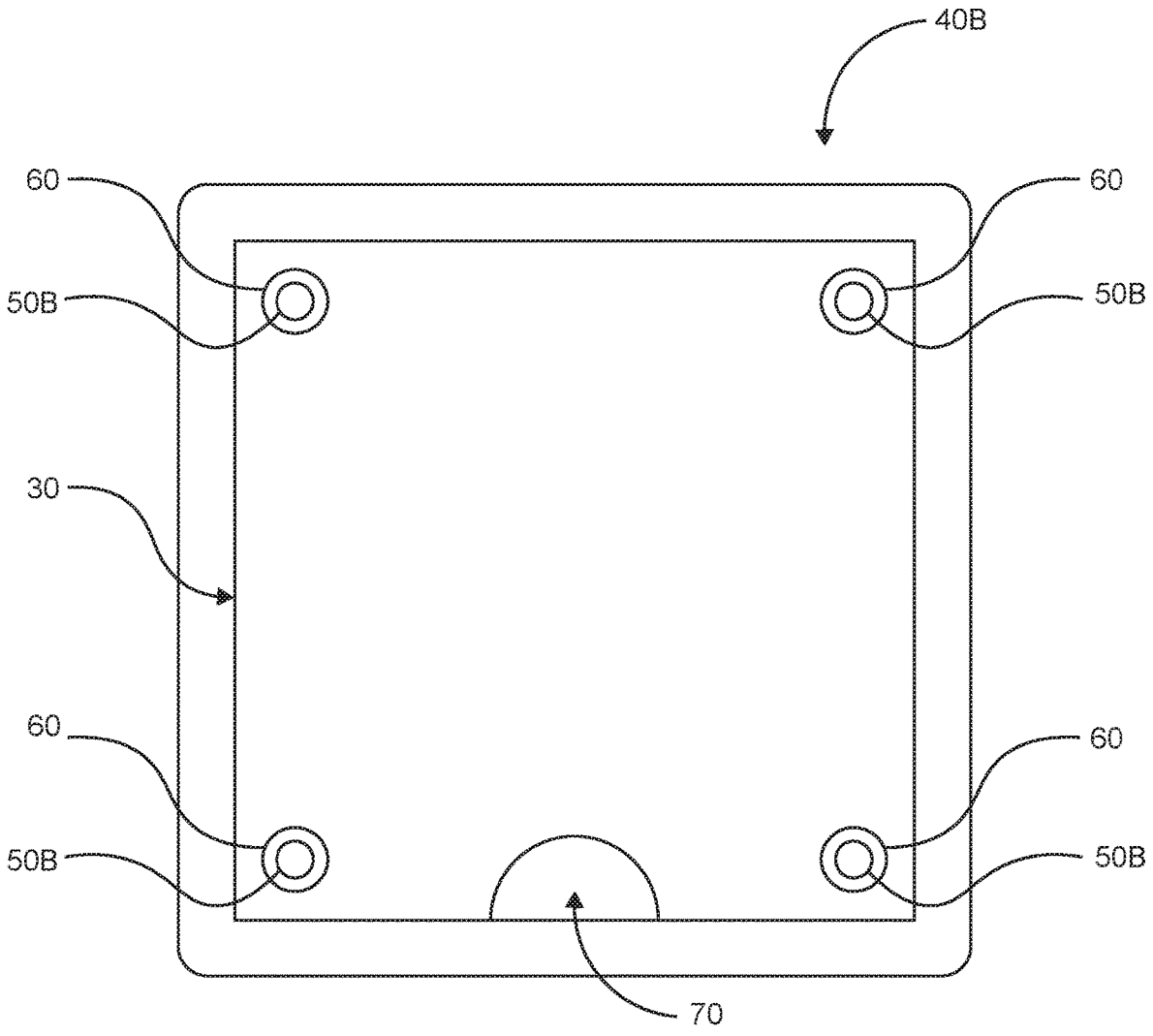
FIG. 4 is a top-down view of the back of the device in the 'closed position' with the displayed item inserted.

| Component Number | Present in Drawing(s) | Component Defined as |
|---|---|---|
| 10 | FIG. 1, FIG. 2, FIG. 3 | Top Face |
| 20 | FIG. 1, FIG. 2, FIG. 3 | Middle Piece |
| 30 | FIG. 1, FIG. 2, FIG. 4 | Bottom Plate |
| — | — | [10 + 20 + 30] Device |
| 40A | FIG. 3 | Frontside of the Device |
| 40B | FIG. 4 | Backside of the Device |
| — | — | [50A + 50B] Magnet sets |
| 50A | FIG. 1, FIG. 2, FIG. 3 | North Magnetic Pole |
| 50B | FIG. 1, FIG. 2, FIG. 4 | South Magnetic Pole |
| 60 | FIG. 1, FIG. 2, FIG. 4 | Grip Dots |
| 70 | FIG. 1, FIG. 2, FIG. 4 | Bevel Cutout |
| 80 | FIG. 2, FIG. 3 | Displayed Item |
| 90 | FIG. 2 | [10 + 20] Top Half |

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a", "an" and "the" are intended to include the plural forms as well as the singular forms, unless the context clearly indicates otherwise. It will be further understood that the terms "comprises" and/or "comprising' when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New coaster closure mechanics utilizing magnets, unique assembly and design, and the concept of customization through the interchanging of displayed items are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by referencing Table B "Drawing Component References" and the drawing figures representing preferred embodiments.

The top face 10 is permanently glued to the middle piece 20 creating the static top half 90 of the device. The top half 90 is flat and even on one of the largest faces. The opposite face has a square shaped recess that extends through but does not exceed the thickness of the top half 90.

Set holes for the magnets are drilled on each of the corners of both the top face 10 and bottom plate 30 components. The holes extend partially through the thickness of each piece. Magnets are installed into the drill holes. The north magnetic pole magnets 50A are permanently installed into the top face 10 and the south magnetic pole magnets 50B are permanently installed into the bottom plate 30.

The bottom plate 30 is inserted into the recessed square of the top half 90 to complete the device. The orientation is such that the exposed portion of the north magnetic pole magnets 50A connect with the exposed portion of the south magnetic pole magnets 50B. This forms the magnetic closure mechanism which does not require a physical connection and can therefore perform through varying thicknesses of displayed items 80.

Grip dots 60 are glued to the bottom plate 30. They are centered on the south magnetic pole magnet 50B locations and are installed opposite the magnets exposed side. The grip dots 60 increase friction between the device and the surface it is sitting on, thereby reducing slip.

The bevel cutout 70 is removed from the bottom plate 30. The beveled edge radiuses outwards in the direction of the top face 10. The semicircle shape and beveled edge assist in the opening of the magnetic closure and removal of the bottom plate 30 by increasing surface area.

When assembled in the preferred embodiments, the device consists of a removable bottom plate 30 and the top half 90 of the device.

When the device is installed with displayed items 80 the grip dots 60, bevel cutout 70 and south magnetic pole magnets 50B are hidden by the displayed item 80 when viewing from the frontside of the device 40A. These features can be viewed from the backside of the device 40B.

The preferred materials are ferromagnetic metals for the magnets, high friction polymer for the grip dots 60 and transparent plastic for the top face 10, middle piece 20, and bottom plate 30.

While preferred materials for elements have been described, the device is not limited by these materials. Wood, plastics, rubber, foam, metal alloys, aluminum, and other materials may comprise some or all of the elements of the device in various embodiments of the present invention.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A plastic, polycarbonate, acrylic or glass and magnetic assembly often, but not exclusively, used as a drink coaster for displaying flat print media and photos, in-between non-luminescent magnetic pressure plates, comprising:

a Top Face comprising magnets and a static transparent pressure plate wherein a displayed item is to be positioned under; and a Middle Piece comprising a ring encirclement that follows an outer perimeter of the Top Face and is positioned and permanently adhered under the Top Face thereby creating a static dam perimeter with a central recessed gap; and a Bottom Plate comprising magnets and a removable pressure plate positioned under the Top Face and within the central recessed gap.

2. The assembly of claim 1, wherein the Top Face and Middle Piece are of comparable thickness and the Bottom Plate is slightly thinner, thereby increasing a height differential from the Bottom Plate to a surface it is resting on, thereby decreasing a risk of water ingress from moisture condensate.

3. The assembly of claim 1, wherein the displayed item is inserted between the Top Face and the Bottom Plate wherein, magnets from the Top Face and the Bottom Plate exert a constant pressure force on the displayed item thereby preventing warpage from moisture.

4. The assembly of claim 1, wherein the Top Face is permanently adhered to the Middle Piece creating one static piece with a static dam perimeter to constrain a shear force effects on the magnets and nullify unwanted dislodgment of the displayed item from slippage of the Top Face and the Bottom Plate.

5. The assembly of claim 1, wherein a Bottom Plate pressure plate is removable from a Top Face pressure plate by magnets where the Alignment of the magnets is such that magnets physically connect when no display item is present, and they magnetically attract and magnetically connect through the display item, when a display item is present.

* * * * *